US007628953B2

(12) United States Patent
Fridlyander et al.

(10) Patent No.: US 7,628,953 B2
(45) Date of Patent: Dec. 8, 2009

(54) ALUMINUM-BASED ALLOY AND THE ARTICLE MADE THEREOF

(75) Inventors: Losif Naumovitch Fridlyander, Moscow (RU); Evgeny Nikolaevitch Kablov, Moscow (RU); Vladislav Valerievitch Antipov, Moscow (RU); Tatiana Petrovna Fedorenko, Moscow (RU); Valery Ivanovitch Popov, Kamensk-Uralsky (RU); Pyotr Vasiljevitch Panchenko, Taganrog (RU)

(73) Assignee: Federalnoe Gosudarstvennoe Unitanoe Predpriyatie "Vserossysky Nauchno-Issledovatelsky Institut Aviatsionnykh Materialov" (FGUP VIAM), Moscow (RU)

( * ) Notice: Subject to any disclaimer, the term of this patent is extended or adjusted under 35 U.S.C. 154(b) by 371 days.

(21) Appl. No.: 11/631,216

(22) PCT Filed: Sep. 6, 2004

(86) PCT No.: PCT/RU2004/000322

§ 371 (c)(1),
(2), (4) Date: Dec. 28, 2006

(87) PCT Pub. No.: WO2006/038827

PCT Pub. Date: Apr. 13, 2006

(65) Prior Publication Data

US 2008/0292491 A1 Nov. 27, 2008

(51) Int. Cl.
*C22C 21/16* (2006.01)

(52) U.S. Cl. ..... 420/533; 148/417

(58) Field of Classification Search ..... 420/533
See application file for complete search history.

(56) References Cited

U.S. PATENT DOCUMENTS

| | | | | |
|---|---|---|---|---|
| 4,795,502 | A | 1/1989 | Cho | |
| 5,374,321 | A | 12/1994 | Gatenby et al. | |
| 6,630,039 | B2 * | 10/2003 | Lukasak et al. | 148/690 |

FOREIGN PATENT DOCUMENTS

| | | |
|---|---|---|
| GB | 522050 | 6/1940 |
| GB | 2216542 A | 10/1989 |
| RU | 2180928 C1 | 3/2002 |

* cited by examiner

*Primary Examiner*—Roy King
*Assistant Examiner*—Yoshitoshi Takeuchi
(74) *Attorney, Agent, or Firm*—Duane Morris LLP

(57) ABSTRACT

The present invention relates to aluminum-based alloy of Al—Cu—Mg—Li type and to an article made thereof which are intended to be used in aircraft and aerospace vehicles.

While having high strength properties (ultimate strength level and yield strength level) the suggested alloy has a reduced sound conductivity upon acoustic influence.

The invented alloy contains (mass. %):

| | |
|---|---|
| Li | 1.7-2.0 |
| Cu | 1.6-2.0 |
| Mg | 0.7-1.1 |
| Zr | 0.04-0.2 |
| Be | 0.02-0.2 |
| Ti | 0.01-0.1 |
| Ni | 0.01-0.15 |
| Mn | 0.01-0.4 |
| S | $0.5 \cdot 10^{-4}$-$1.0 \cdot 10^{-4}$ |
| N | $0.5 \cdot 10^{-4}$-$1.0 \cdot 10^{-4}$ |
| Co | $0.5 \cdot 10^{-6}$-$1.0 \cdot 10^{-6}$ |
| Na | $0.5 \cdot 10^{-3}$-$1.0 \cdot 10^{-3}$ |
| Al-balance | |

Sheets of said alloy are particularly suited to be used as structural material for aircraft and aerospace vehicles in the form of skin and a primary sheets' set.

2 Claims, No Drawings

ALUMINUM-BASED ALLOY AND THE ARTICLE MADE THEREOF

TECHNICAL FIELD

This invention relates to non-ferrous metallurgy, and in particular it relates to aluminium-based alloys of Al—Cu—Mg—Li type. The semi-finished products made of such alloys are useful as structural materials for aircraft and aerospace vehicles in the form of a skin material and a primary sheets' set.

BACKGROUND ART

The alloys of Al—Cu—Mg—Li type are widely used in the aircraft and aerospace industries. Well-known are the American alloys having the chemical composition as follows (in mass %):

| | | |
|---|---|---|
| Li | 1.9-2.6 | |
| Cu | 1.0-2.2 | |
| Mg | 0.4-1.4 | |
| Mn | 0-0.9 | |
| Ni | 0-0.5 | |
| Zn | 0-0.5 | |
| Zr | 0-0.25 | |
| Al-balance | | (1) |
| Li | 1.5-2.5 | |
| Cu | 1.6-2.8 | |
| Mg | 0.7-2.5 | |
| Zr | 0.05-0.2 | |
| Fe | ≦0.5 | |
| Si | ≦0.5 | |
| Al-balance | | (2) |

The abovesaid alloys while having reduced density and acceptable mechanical properties in the course of single- and repeated loading, are highly sound-conductive upon acoustic influence. For some aircraft and aerospace vehicles the sound absorbing properties are predominating.

Also known is the Russian alloy 1441 having the chemical composition as follows (mass %):

| | |
|---|---|
| Li | 1.7-2.0 |
| Cu | 1.6-2.0 |
| Mg | 0.7-1.1 |
| Zr | 0.04-0.2 |
| Be | 0.02-0.2 |
| Ti | 0.01-0.1 |
| Ni | 0.01-0.15 |
| Mn | 0.01-0.4 |
| Ga | 0.001-0.05 |
| H | $1.5 \cdot 10^{-5}$-$5.0 \cdot 10^{-5}$ |

at least one element from the group comprising:

| | | |
|---|---|---|
| Zn | 0.01-0.3 | |
| Sb | 0.00003-0.015 | |
| Na | 0.0005-0.001 | |
| Al-balance | | (3) |

Said alloy is attractive in providing an improved combination of strength and plasticity. The sheet made of this alloy has the following properties: $\sigma_\beta \geqq 410$ MPa, $\sigma_{0.2} \geqq 305$ MPa, $\delta \geqq 7\%$, $K_{app} \geqq 100$ MPa$\sqrt{m}$. Nevertheless, the aircraft skin made of said alloy has a sound-absorbing property which is not high enough.

DISCLOSURE OF THE INVENTION

The object of the present invention is to provide the aluminium-based alloy having high strength properties (ultimate strength level and yield strength level) parallel with a reduced sound-conductivity upon acoustic influence. Accordingly, there is provided Al—Cu—Mg—Li alloy comprising (mass %):

| | |
|---|---|
| Li | 1.7-2.0 |
| Cu | 1.6-2.0 |
| Mg | 0.7-1.1 |
| Zr | 0.04-0.2 |
| Be | 0.02-0.2 |
| Ti | 0.01-0.1 |
| Ni | 0.01-0.15 |
| Mn | 0.01-0.4 |
| S | $0.5 \cdot 10^{-4}$-$1.0 \cdot 10^{-4}$ |
| N | $0.5 \cdot 10^{-4}$-$1.0 \cdot 10^{-4}$ |
| Co | $0.5 \cdot 10^{-6}$-$1.0 \cdot 10^{-6}$ |
| Na | $0.5 \cdot 10^{-3}$-$1.0 \cdot 10^{-3}$ |
| Al-balance, | |

and the article made thereof.

Sulphur and nitrogen being present in the composition, cause the formation of sulphides and nitrides and create some acoustic nonuniformity which in turn promotes the increase of the supersound attenuation factor, that is why the sound-absorbing property of the material is enhanced. Cobalt is concentrated on the grains' boundaries thereby promoting grain-boundary deformation. In this connection the ability of the alloy to deformation is improved and the technological plasticity is increased.

BEST MODES FOR CARRYING OUT INVENTION

The ingots of 4 alloys were cast under laboratory conditions. The compositions of the invented alloy and of the prior art alloys are listed in Table I wherein the alloys 1-3 are the alloys according to the invention, and the alloy 4 is the example of the known alloy 1441 according to RU 2180928.

The sheets having thickness of 1.5 mm were fabricated from the ingots by extruding a strip followed by hot and cold rolling. The extruding step was performed at 430° C., and hot rolling step—at 440-450° C. The sheets were cut into blanks which were water quenched from 530° C. followed by natural aging at 150° C. for 24 hours. The samples for evaluation of supersound attenuation factor were fabricated from said blanks. The supersound attenuation factor is the main feature which determines the material's ability to absorb sound waves hence to increase noise-absorbing value. The supersound attenuation factor was evaluated by echo-impulsive method on longitudinal waves in frequency range of 10, 20 and 30 MHz. The results of the tests are listed in Table 2. From the examination of tests' results it became evident that the invented alloy has practically the same ultimate strength level and specific elongation value as prior art alloys do, but its sound-absorbing value determined by supersound attenuation factor, is~30% higher than that of the prior art alloys.

Thus, the usage of the suggested alloy for aerospace applications as structural material for aircraft skin and primary sheets' set, provides the significant increase in sound-absorbing property.

TABLE 1

CHEMICAL COMPOSITION OF ALLOYS (mass. %)

| Alloy number | Li | Cu | Mg | Zr | Be | Ti | Ni | Mn | S | N | Co | Na | Ga | H | Al |
|---|---|---|---|---|---|---|---|---|---|---|---|---|---|---|---|
| 1 | 1.7 | 1.6 | 0.7 | 0.04 | 0.02 | 0.01 | 0.01 | 0.01 | $0.5 \cdot 10^{-4}$ | $0.5 \cdot 10^{-4}$ | $0.5 \cdot 10^{-6}$ | $0.5 \cdot 10^{-3}$ | — | — | Balance |
| 2 | 1.85 | 1.8 | 0.9 | 0.12 | 0.11 | 0.055 | 0.08 | 0.205 | $0.75 \cdot 10^{-4}$ | $0.75 \cdot 10^{-4}$ | $0.75 \cdot 10^{-6}$ | $0.75 \cdot 10^{-3}$ | — | — | Balance |
| 3 | 2.0 | 2.0 | 1.1 | 0.2 | 0.2 | 0.1 | 0.15 | 0.4 | $1.0 \cdot 10^{-4}$ | $1.0 \cdot 10^{-4}$ | $1.0 \cdot 10^{-6}$ | $1.0 \cdot 10^{-3}$ | — | — | Balance |
| 4 | 1.7 | 1.8 | 0.8 | 0.12 | 0.02 | 0.05 | 0.1 | 0.3 | — | — | — | $1.0 \cdot 10^{-3}$ | 0.05 | $2.0 \cdot 10^{-5}$ | Balance |

TABLE 2

MECHANICAL PROPERTIES OF ALLOYS

| Alloy number | Ultimate tensile strength, MPa | Yield strength in elongation, MPa | Elongation, % | Fracture toughness ($K_{app}$), MPa√m | Supersound attenuation factor, dB/m |
|---|---|---|---|---|---|
| 1 | 410 | 305 | 15 | 110 | 28 |
| 2 | 415 | 310 | 13 | 105 | 29 |
| 3 | 420 | 315 | 12 | 100 | 30 |
| 4 | 410 | 305 | 14 | 105 | 21 |

The invention claimed is:

1. Aluminium-based alloy comprising Li, Cu, Mg, Zr, Be, Ti, Ni, Mn, Na, characterized in that said alloy additionally contains Co, S and N, provided that the ratio of components is as follows (mass. %):

| | |
|---|---|
| Li | 1.7-2.0 |
| Cu | 1.6-2.0 |
| Mg | 0.7-1.1 |
| Zr | 0.04-0.2 |
| Be | 0.02-0.2 |
| Ti | 0.01-0.1 |
| Ni | 0.01-0.15 |
| Mn | 0.01-0.4 |
| S | $0.5 \cdot 10^{-4}$-$1.0 \cdot 10^{-4}$ |
| N | $0.5 \cdot 10^{-4}$-$1.0 \cdot 10^{-4}$ |
| Co | $0.5 \cdot 10^{-6}$-$1.0 \cdot 10^{-6}$ |
| Na | $0.5 \cdot 10^{-3}$-$1.0 \cdot 10^{-3}$ |
| Al-balance. | |

2. An article made of the aluminium-based alloy of claim 1.

* * * * *